US012256820B2

(12) United States Patent
Verziagi et al.

(10) Patent No.: US 12,256,820 B2
(45) Date of Patent: Mar. 25, 2025

(54) EYEGLASSES CASE WITH LATERAL SPRING MEANS AND CAM

(71) Applicant: LUXOTTICA GROUP S.P.A., Milan (IT)

(72) Inventors: Davide Verziagi, Domegge di Cadore (IT); Luca Carnelos, Domegge di Cadore (IT); Alessandro Donoli, Agordo (IT); Alberto Lovato, Vicenza (IT)

(73) Assignee: LUXOTTICA GROUP S.P.A., Milan (IT)

( * ) Notice: Subject to any disclaimer, the term of this patent is extended or adjusted under 35 U.S.C. 154(b) by 0 days.

(21) Appl. No.: 18/502,393

(22) Filed: Nov. 6, 2023

(65) Prior Publication Data

US 2024/0148119 A1 May 9, 2024

(30) Foreign Application Priority Data

Nov. 9, 2022 (IT) ..... 102022000023097

(51) Int. Cl.
*A45C 11/04* (2006.01)

(52) U.S. Cl.
CPC ..... *A45C 11/04* (2013.01)

(58) Field of Classification Search
CPC ..... A45C 11/04
USPC ..... 206/5, 6
See application file for complete search history.

(56) References Cited

U.S. PATENT DOCUMENTS

| | | | | |
|---|---|---|---|---|
| 6,216,930 | B1 * | 4/2001 | Plocher | B60R 7/082 206/5 |
| 11,322,959 | B1 * | 5/2022 | Ardisana, II | A45C 11/04 |
| 2002/0133906 | A1 * | 9/2002 | Fedon | E05D 1/02 16/225 |
| 2004/0195113 | A1 * | 10/2004 | Yoshizawa | A45C 11/04 206/5 |
| 2005/0155872 | A1 * | 7/2005 | Cheng | A45C 11/04 206/6 |
| 2009/0057165 | A1 * | 3/2009 | Park | A45C 11/04 206/5 |
| 2020/0099231 | A1 * | 3/2020 | Nobre | G06F 1/163 |

* cited by examiner

*Primary Examiner* — Jacob K Ackun

(57) ABSTRACT

An eyewear case for carrying eyeglasses comprises a container having a central body and two opposite sides integrally joined at the ends of the central body, a lid movable so to open and close with respect to the container and comprising a central body and two opposite sides integrally joined to the ends of the central body, a spring mounted on one side of the lid and cooperating with a cam housed in the side of the container.

19 Claims, 2 Drawing Sheets

EYEGLASSES CASE WITH LATERAL SPRING MEANS AND CAM

CROSS-REFERENCE TO RELATED APPLICATIONS

The present application claims priority to Italian patent application no. 102022000023097 filed on Nov. 9, 2022 the content of which is incorporated herein in its entirety.

BACKGROUND OF THE INVENTION

The present invention relates to an eyeglasses case for carrying eyeglasses with a spring and cam system for controlling opening and closing thereof.

It is known in the technical sector relating to the commercialization of eyeglasses that there is the need to provide eyeglasses cases which are able to contain the eyeglasses and which must have characteristics of rigidity, in order to protect the eyeglasses, and a simple and secure closing system for inserting/removing the eyeglasses, as well as having an attractive design and being able to be carried in the pocket or bag of the user.

A further necessary characteristic is the need for secure and irreversible closing of the case when not operated by the user, in order to avoid the undesirable risk of the eyeglasses accidentally falling out and the lens being damaged.

Cases are known where, for this purpose, a hinge is mounted or formed integrally on the back of the case (rear long surface the container), said hinge being able to be associated with a spring designed to automatically close the case and prevent the accidental reopening thereof.

While fulfilling their function, these cases nevertheless have drawbacks which reduce their functionality since they are limited by the position of the rotation axis of the hinge which must necessarily be situated outside the containing volume of the case. The obligatory position of the rotation axis limits the possible movement mechanisms, spring prestressing systems and, finally, design solutions which may be offered.

The technical problem which is posed, therefore, is to provide a case for eyeglasses which is provided with a system for controlling the opening/closing movement able to solve the problems of the prior art.

It is also required that the system should not reduce excessively the containing volume of the case and should be able to be covered so to avoid the risk of the moving parts being exposed to the end user.

A further object of the invention consists in the possibility of allowing opening of the case, by moving the lid with one hand only.

In connection with these problems, it is also preferable that such a case should be easy and inexpensive to produce and assemble and that the final weight thereof should be limited.

These results are obtained according to the present invention by an eyewear case according to the herein disclosed subject matter.

BRIEF DESCRIPTION OF THE SEVERAL VIEWS OF THE DRAWING

Further details may be obtained from the following description of a non-limiting example of embodiment of the subject of the present invention provided with reference to the attached drawings in which.

DETAILED DESCRIPTION OF THE INVENTION

Figure 1:
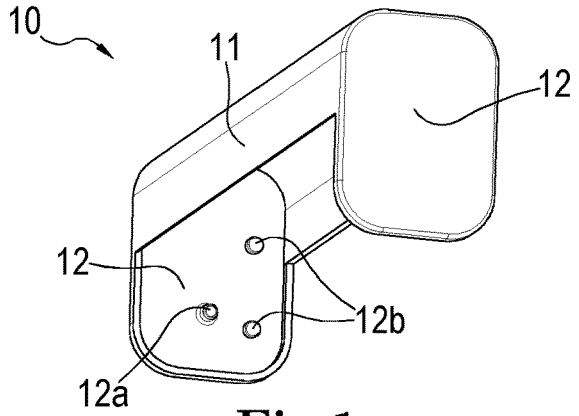
FIG. 1: shows a perspective view of a lid forming part of a case according to the present invention.
Figure 2:
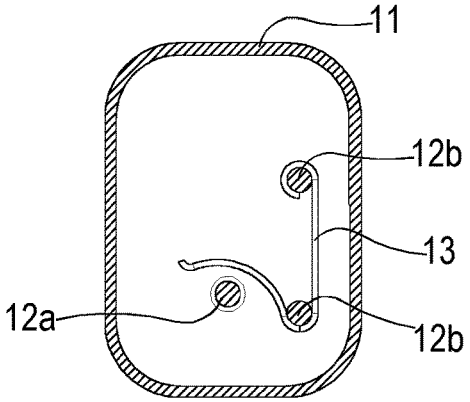
FIG. 2: shows a schematic cross-sectional view of the lid according to FIG. 1 with a recall spring mounted thereon.

As shown in FIGS. 1-9, a preferred example of embodiment of a eyewear case according to the present invention comprises a lid 10 (FIG. 1) formed by a central body 11 extending with its greatest dimension in a longitudinal direction and provided with two opposite sides 12 extending in the vertical direction.

Each side 12 comprises in particular:

- at least one first pin 12*a* designed to form an axis of rotation for the lid;
- at least two further locating pins 12*b*, which form a preferred example of embodiment of engagement means for a shaped spring 13, the function of which will become clear below.

The case according to the invention furthermore comprises a container 20 (FIG. 3) comprising a central body 21 extending with its greatest dimension in the longitudinal direction and joined to two opposite sides 22 extending in the vertical direction.

Figure 3:
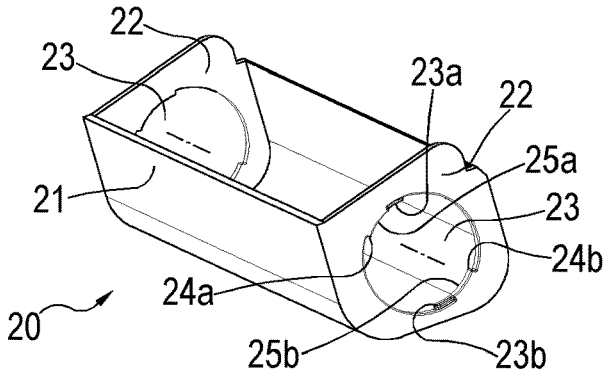
FIG. 3: shows a perspective view of a container forming part of a case according to the present invention.
Figure 4:
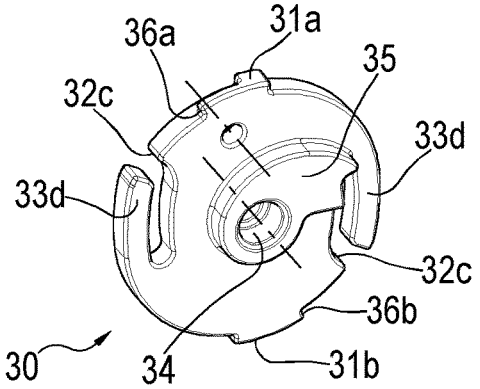
FIG. 4: shows a schematic perspective view of a guide cam element which can be mounted on the container according to FIG. 3.

As shown in FIG. 3, each side 22 comprises a respective opening 23 configured to house a cam element 30. The opening 23 is in particular shaped to allow insertion of the cam element 30 in the side 22 and subsequent locking thereof both in the axial direction and in rotation of the cam element 30 with respect to the side 22; as will emerge more clearly below, preferably, the opening 23 defines respective seats 23*a*,23*b* in the side of the container, designed to form respective stops 24*a*,24*a*,24*b*; 25*a*,25*b* for correct and stable housing of the cam element 30.

Although shown with an opening 23 for each side 22, so as to favour more balanced relative movements of lid and container, it is envisaged that the latter may have only one opening or recess on only one of the two sides. Preferably, it is also possible to envisage end-of-travel means (not shown) which are designed to limit the opening of the lid; an example of these end-of-travel means may be defined by a further pin present in the side 12 of the lid and designed to cooperate with a corresponding stop defined by the container 20.

The preferred cam element 30 shown has a substantially circular shape and has:

- an annular edge provided with projecting teeth 31*a*,31*b* shaped for insertion and engagement of the cam 30 inside the opening 23 in the side 22 of the container 20;
- recesses 32*c* extending towards the inside of the body of the cam 30 and with oppositely directed openings; each recess defines a respective finger 33*d* which is elastically deformable inwards (towards the axis of rotation) so as to facilitate insertion inside the opening 23 of the container and an opposite elastic reaction for stable positioning against the inner wall thereof, in particular an abutting arrangement (FIG. 9) against the respective stop 24*a*, 24*b* of the seat 23*a*,23*b* in order to ensure stable relative engagement once insertion has been performed.

As shown, in a preferred embodiment, the teeth 31*a*,31*b* are arranged opposite each other along a first diameter of the cam element and the fingers 33*d* are arranged opposite each other along a second diameter of the cam 30. In the central position (FIG. 8, 9) the cam has a hole 34 suitable for coupling with the rotation pin 12*a* of the lid 10 and a suitably shaped (raised) arm 35, which is eccentric with respect to the rotation pin and is designed to interact with a spring 13 during opening of the lid, in order to cause deformation thereof, increasing the load thereof and therefore generating a recall reaction of said spring into the initial position for closing the lid.

Figure 8:
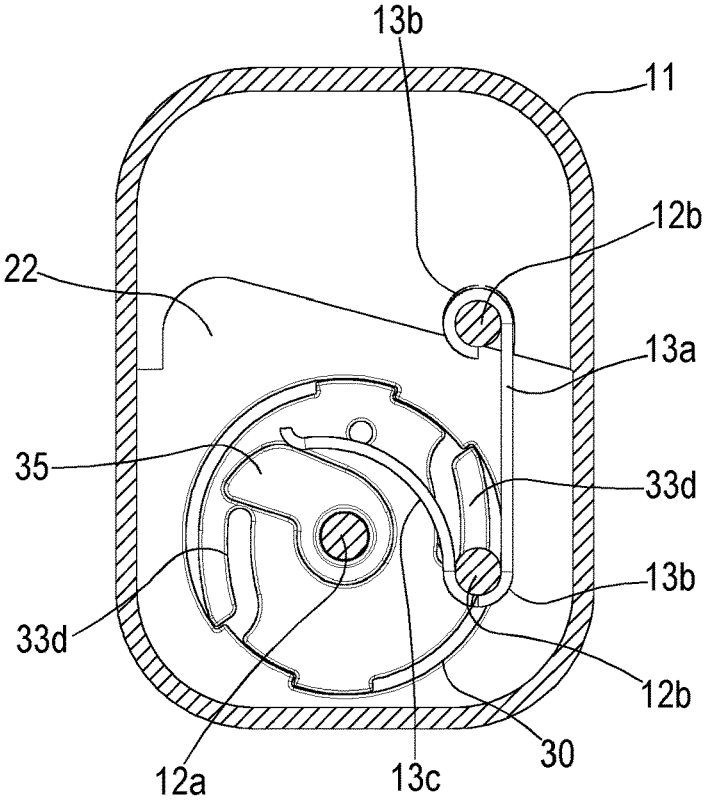
FIG. 8: shows a schematic cross-sectional view of a side of the closed case according to FIG. 7.
Figure 9:
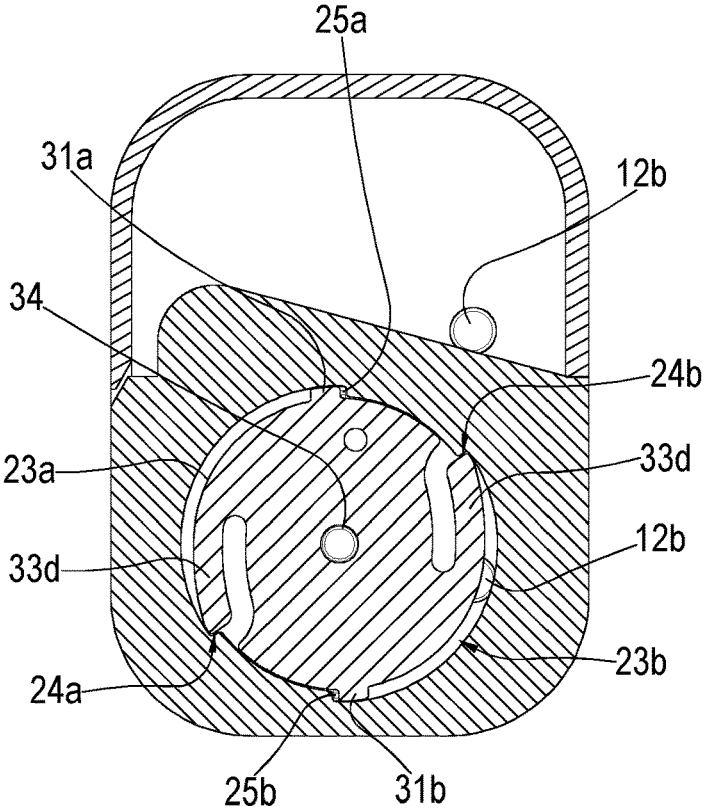
FIG. 9: shows a schematic cross-sectional view of a side of the case according to FIG. 7, along a cross-sectional plane of the side of the container different from that shown in FIG. 8.

As shown in FIG. 8, the spring 13 is a preferred example of a spring element designed to be mounted on the side 12 of the lid 10 and to cooperate with the respective cam 30 integrally joined with the side 22 of the container 20 so as to push the lid towards the closed position.

In greater detail, the spring element 13 comprises a first part 13*a* fixed to the side 12 of the lid, for example by means of respective shaped engagement features 13*b* for engaging over a respective pin of the further pins 12*b*, and a deformable arm 13*c* designed to be arranged in operative engagement on the cam arm 35.

For assembly of the container, in a first assembly position, the cam element 30 may be axially inserted inside the respective opening 23 of the container 20, by coupling the rotation pin 12*a* of the lid 10 together with the hole 34 in the cam, without stressing the latter.

By rotating the cam with a suitable tool, the teeth 31*a* and 31*b* are engaged inside the respective shaped seats 23*a* and 23*b* until they engage with the respective stops 25*a*, 25*b*, thereby axially constraining the cam 30 with respect to the container 20, and the elastic locking teeth 33*d* are forced to snap-engage with the respective anti-rotation stops 24*a*,24*b*, resulting in locking of the relative rotation of the cam with respect to the container 20, beyond the stops 24*a* and 24*b*.

The arrangement of the spring 13 in operative coupling with the cam 30 causes the spring 13, once the cam 30 has been positioned, to be prestressed (with the arm 13*c* elastically deformed) in a stable closing position.

In a preferred embodiment, at least one mechanical stop (not shown) of the container 20 is also provided in order to prevent excessive prestressing of the spring 13 and/or accidental rotation of the spring with respect to the container during rotation of the lid for opening or closing the case.

Advantageously, during opening of the case, the relative rotation between lid and cam will result in a deformation of the spring which will impart thereto first the prestress and then the working load and the consequent recall force which will push the lid again into the closed position.

Figure 5:
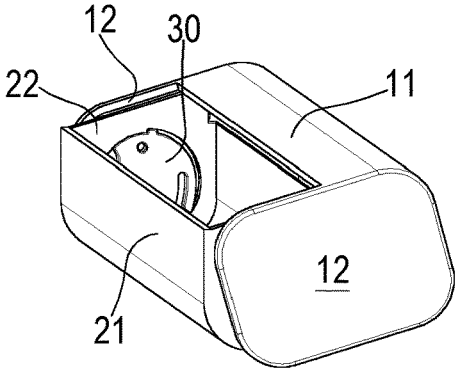
FIG. 5: shows a perspective view of a case according to the present invention in the assembled and open condition.
Figure 6:
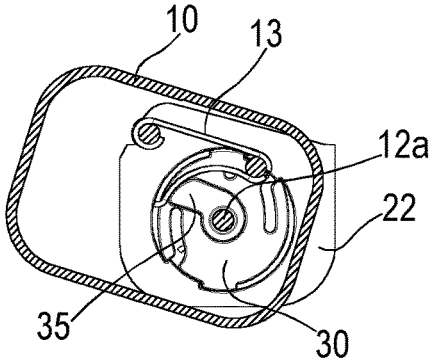
FIG. 6: shows a schematic cross-sectional view of a side of the open case according to FIG. 5.
Figure 7:
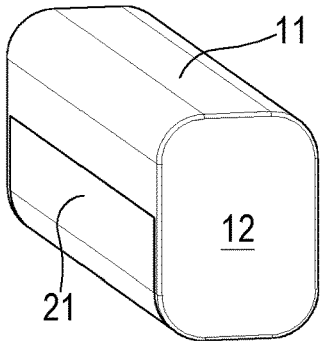
FIG. 7: shows a perspective view of a case according to the present invention in the assembled and closed condition.

In detail, the simultaneous engagement of the elastic teeth 33*d* with the stops 24*a* and 24*b* as well as of the elements 36*a* and 36*b* with the stops 25*a* and 25*b* constrains in both directions the relative rotation of the cam and container. As shown in FIGS. 5, 6 and 7, once the case has been assembled, the container 20 and the lid 10 are coupled together along the respective opposite sides so that the lid may rotate, during opening/closing of the case, with respect to the container about a longitudinal axis of rotation, between a closed position (FIG. 7) and a fully open position (FIG. 5) in which the eyeglasses may be inserted/removed inside/from the containing volume of the case, in particular in a direction of insertion substantially perpendicular to the longitudinal axis X-X and parallel to the lateral flanks of the case.

As shown in FIGS. 5 and 6, opening of the lid 10 is performed by rotation thereof about the pin 12*a*, for example in an anti-clockwise direction, relative to the container 20.

During the opening rotation of the lid 10, the cam arm 35, resting on one end of the spring 13, causes compressive deformation thereof which forces the arm 13*c* of the spring 13 to be deformed towards the fixed arm 13*a* of the said spring.

By deforming in this direction, the spring load will be increased, producing a reaction which will push the lid towards the closed position.

During closing rotation, if the lid is left free in the totally or partially open position, there will be a reaction of the spring which will tend to return into the rest position, therefore pushing against the shaped arm 35 and generating a force which will cause the lid to close.

Once closing has been completed, the prestress imparted to the spring during assembly of the components will maintain a residual force which will tend to keep the case closed.

According to the invention the possibility is provided of using forms and dimensions of the eccentric cam in order to produce different recall forces in the different relative angular positions of the container and lid.

The shape of the spring and the dimensions (thickness and height) of the spring may also be different.

By modifying the rigidity and prestressing of the spring it is possible to vary the degree of resistance to opening and the force which recalls the lid into the closed position.

Alternative embodiments may not have the two pins for engagement with the spring element 13, which could be replaced, for example, by different engagement structures, such as a single pin or a locating seat for a spring, also with a different form, without substantially modifying its function.

It is therefore clear how the volume of the cam and the rotation pins and the extension of the spring in its working positions may be essentially contained within a thin disc which has its axis parallel to the axis of rotation and may therefore be easily contained within the sides of the case; in addition to this, the correct positioning of the rotation axis according to the invention is able to provide an eyeglasses case with a compact volume of the container/lid assembly both in the open position and in the closed position and with an improved working volume compared to the prior art.

The positioning, on the sides, of the lid operating device also allows the case to be opened/closed with one hand and the moving parts to be covered so as to ensure greater safety for the end user.

Although described in connection with a number of embodiments and a number of preferred examples of implementation of the invention, it is understood that the scope of protection of the present patent is determined solely by the claims below.

The invention claimed is:

1. Eyewear Case for eyeglasses comprising:

a container, comprising an elongated central body with a greatest dimension parallel to a longitudinal axis, and two opposite sides integrally joined to opposite ends of the central body;

a lid comprising an elongated central body with a greatest dimension parallel to a longitudinal axis, and two opposite sides which are respectively integrally joined to opposite ends of the central body;

a spring means mounted on the lid, wherein the container and the lid are formed to be coupled along the respective opposite sides such that the lid can rotate relative to the container about a longitudinal axis of rotation for opening/closing the case, between a closed position and an open position;

wherein said spring means comprise at least one spring element mounted on at least one respective side of said opposite sides of the lid, and wherein the respective at least one side of the container has an opening which houses a cam element arranged and configured to cooperate with the spring element so as to push the lid towards the closed position.

2. Case according to claim 1, wherein one or both of said sides of the lid comprise/s a first pin designed to form the longitudinal axis of rotation for the lid.

3. Case according to claim 1, wherein the cam element is stably housed in the respective side of the container so as to be rotationally fixed with respect to the container.

4. Case according to claim 1, wherein said at least one side of said sides of the lid comprises engagement means for mounting the respective spring element.

5. Case according to claim 4, wherein said engagement means comprises one or more further locating pins.

6. Case according to claim 1, wherein said opening in the side of the container defines a pair of seats for inserting and positioning the cam element.

7. Case according to claim 1, wherein an outer annular edge of the cam element is provided with teeth designed to abut against corresponding first stops of the opening in the side of the container.

8. Case according to claim 6, wherein each seat of the pair of seats of the opening for inserting and positioning the cam element defines a respective first stop, wherein an outer annular edge of the cam element is provided with teeth and each tooth abuts on a respective one of said first stops.

9. Case according to claim 1, wherein the cam element has a hole in a central position for coupling with a rotation pin of the lid and a shaped arm which is eccentric with respect to the axis of rotation and designed to interact with the spring element so as to cause a deformation thereof when the lid is rotationally operated relative to the container for opening the case.

10. Case according to claim 1, wherein the cam element has locating elements configured to allow insertion into the opening of the side and prevent axial displacement and/or rotation of the cam element with respect to the container.

11. Case according to claim 1, wherein the cam element has a pair of recesses extending towards the inside of a cam body of the cam element and with oppositely directed openings; each recess defining a respective tooth elastically deformable towards the axis of rotation in order to facilitate insertion into the opening of the side of the container and cause an elastic reaction against an internal edge thereof for stable positioning of the cam element.

12. Case according to claim 1, wherein in the closed position of the lid the spring element is prestressed by the cam element.

13. Case according to claim 1, wherein the container comprises at least one mechanical stop designed to limit prestressing of the spring element.

14. Case according to claim 11, wherein the opening in the side of the container has second stops, said elastically deformable outer teeth of the cam element bearing against a respective one of said second stops so as to prevent relative rotation between container and cam element.

15. Case according to claim 14, wherein each of said second stops is defined by a respective one of a pair of seats of the opening.

16. Case according to claim 1, wherein the spring element comprises a first part and a deformable arm, the deformable arm designed to be arranged in operative engagement on the cam element.

17. Case according to claim 16, wherein the first part of the spring element is fixed to the side of the lid.

18. Case according to claim 17, wherein of the first part of the spring element has one or more shaped engagement features engaging over respective one or more further locating pins of the side of the lid.

19. Case according to claim 16, wherein the deformable arm is designed to be arranged in operative engagement on a cam arm of the cam element.

* * * * *